US006848515B2

(12) United States Patent
Orr et al.

(10) Patent No.: US 6,848,515 B2
(45) Date of Patent: Feb. 1, 2005

(54) MODULAR DRILLING RIG SUBSTRUCTURE

(75) Inventors: Alan Orr, Tulsa, OK (US); Mark Trevithick, Houston, TX (US)

(73) Assignee: Helmerich & Payne, Inc., Tulsa, OK (US)

( * ) Notice: Subject to any disclaimer, the term of this patent is extended or adjusted under 35 U.S.C. 154(b) by 0 days.

(21) Appl. No.: 10/422,427

(22) Filed: Apr. 24, 2003

(65) Prior Publication Data

US 2004/0211572 A1 Oct. 28, 2004

(51) Int. Cl.[7] ..... E21B 7/00

(52) U.S. Cl. ..... 173/1; 173/28; 173/32; 173/34

(58) Field of Search ..... 173/28, 32, 81, 173/34; 175/24, 52, 85; 211/70.4; 405/195.1, 203, 204, 205; 166/350, 359, 367

(56) References Cited

U.S. PATENT DOCUMENTS 2,594,847 A * 4/1952 Bate et al. ..... 173/37
3,145,786 A * 8/1964 O'Neill et al. ..... 175/85
3,365,008 A * 1/1968 Zimmerman et al. ..... 175/85
4,744,710 A * 5/1988 Reed ..... 414/22.63
4,899,832 A 2/1990 Bierscheid, Jr. ..... 173/23
5,593,250 A * 1/1997 Smith et al. ..... 405/205
5,657,823 A * 8/1997 Kogure et al. ..... 166/340
6,030,148 A * 2/2000 Tormala et al. ..... 405/196

* cited by examiner

*Primary Examiner*—Scott A. Smith
*Assistant Examiner*—Nathaniel Chukwurah
(74) *Attorney, Agent, or Firm*—Head, Johnson & Kachigian

(57) ABSTRACT

A process to transport and assemble a drilling or workover rig substructure. The process includes the steps of transporting a driller side substructure section and an off driller side substructure section to a rig site so that the sections are spaced from and parallel to each other. A center substructure section is transported to the rig site. The center substructure section is moved into a space between the driller side and the off driller side sections. The center substructure section is thereafter connected to the driller side and to the off driller side subsections. A floor of the driller side substructure and a floor of the off driller side substructure are raised while both connected to the center substructure section from a transport position to a use position while maintaining the floors parallel to the bases.

44 Claims, 8 Drawing Sheets

MODULAR DRILLING RIG SUBSTRUCTURE

BACKGROUND OF THE INVENTION

1. Field of the Invention

The present invention relates to a modular drilling or workover rig substructure which may be transported to and from a rig site without entirely dismantling the substructure. In particular, the present invention is directed to a modular drilling rig substructure that may be transported to and from a rig site with various drill floor equipment and hand rails remaining in place and that minimizes liquid discharge by providing an integrated containment and drainage system.

2. Prior Art

A drilling rig substructure is one important component of a drilling or workover rig. Typically, a drilling rig substructure includes a raised platform or drilling floor which is above the level of a main deck or cellar deck and above the level of a well head, a blowout preventer and other equipment. An upstanding mast is connected to a floor of the rig and is often supported by the substructure. The mast may extend from 30 to 60 meters so that a substantial amount of weight is supported by the substructure.

The drilling rig substructure includes certain drilling floor equipment and supports personnel for various operations such as connecting and disconnecting pipe sections. Examples of equipment on the drilling floor include rotary tables, power tong apparatus, pipe handling systems, hydraulic winches, powered hoists and controls operated by personnel. Additionally, a V-door ramp may extend from the floor for movement of tubulars and equipment.

It is often necessary to move a drilling or workover rig, including all of its equipment, from one site to another. Traditionally, a rig substructure is assembled or rigged up by assembling the various component pieces of the substructure. For example, a framework is assembled and a plurality of floor panels are put in place to support the equipment and personnel on the drilling floor. While the floor panels are adequate for the purpose of support, they typically do not form a liquid-tight floor section. Accordingly, oil, liquids or debris may run off in the surrounding area. Increasingly, it is desirable to contain any such run-off.

Conversely, the drilling rig substructure is typically disassembled or rigged down by disassembling the various component pieces of the substructure. The various components are then transported to an alternate rig site and the entire process is again repeated.

In the past, various attempts have been made to place various equipment together in modular arrangements. For example, Bierscheid, Jr. (U.S. Pat. No. 4,899,832) discloses a modular drilling apparatus with a combined mast and drilling platform to facilitate assembly and disassembly of the drilling rig. Bierscheid, Jr. does not, however, provide a modular substructure.

It would be advantageous to provide a modular substructure apparatus and method wherein modular components could be moved to and from a rig site by trailer or other vehicle.

It would be advantageous to provide a modular substructure apparatus and process wherein various drill floor equipment and hand rails could remain in place during rig up, during rig down and during transportation operations.

It would also be desirable to provide a modular substructure apparatus and method to facilitate zero liquid discharge from the drill floor by providing an integrated substructure floor and drainage system.

It would be desirable to provide a modular substructure apparatus and method eliminating the requirement of a crane or a gin pole to assemble or rig up and to disassemble or rig down the substructure at a rig site.

It would be advantageous to provide a modular substructure apparatus and method wherein various structural, hydraulic and piping connections could be made at ground level prior to raising the drilling floor to its upstanding, use position.

It would be advantageous to provide a modular drilling rig substructure wherein component sections are joined by connectors not exposed to hook, rotary or set back live loads.

It would be advantageous to provide a modular drilling rig substructure having a drilling floor movable between a lowered, transportation position and an upstanding use position wherein the drilling floor remains parallel to a base at all times.

SUMMARY OF THE INVENTION

The present invention is directed to a modular drilling rig substructure which is comprised of three discreet, modular components—driller side substructure section, center substructure section and an off driller side substructure section. The center section is juxtaposed and lies between the driller side substructure section and the off driller side substructure section.

The driller side substructure section includes a base having a lower skid suitable to be lowered on, loaded off and transported from a trailer or other vehicle. Parallel to and above the base is a floor frame assembly. Pivotally connected between the base and floor frame assembly are a pair of front legs, a pair of middle legs and a pair of rear legs. The front legs, middle legs and rear legs are each pivotally connected to the base. Likewise, the front legs, the middle legs and the rear legs are pivotally connected to the floor frame assembly of the driller side substructure section. Accordingly, the floor frame assembly, the base, the front legs, and the rear legs form a parallelogram. The floor frame assembly can thus move between an upright, in-use position and a lower position parallel to and adjacent to the base for transportation.

The off driller side substructure section operates in the same manner. The off driller side substructure section includes a base, a pair of front legs, middle legs and a pair of rear legs. The front legs, middle legs, and rear legs are each pivotally connected to the base. Likewise, the front legs, middle legs, and rear legs are each pivotally connected to a floor frame assembly of the off driller side substructure section. Accordingly, the floor frame assembly, the base, the front legs and the rear legs together form a parallelogram. In order to assemble a drilling or workover rig substructure, the driller side substructure section and the off driller side substructure section are each transported to a selected rig site in a lowered position. The base of the driller side substructure section is adjacent a drawworks while the base of the off drillers side substructure section is adjacent the drawworks. The driller side substructure section and the off driller side substructure section are parallel to each other and are also spaced apart from each other. Once the off driller side section and the driller side section are in place, the center substructure section is transported and brought to the rig site. The center substructure section is transported on the trailer of a truck with the space between the two side sections being wider than the width of the truck. Accordingly, the truck can back up between the side sections to deposit the center section in place. Thereafter, the center substructure section is pinned to the driller side substructure section and the center section is pinned to the off driller side substructure section.

An hydraulic cylinder between the base and floor assembly on the driller side substructure section is utilized to raise the substructure into the upright, use position. Likewise, an hydraulic cylinder between the base and floor assembly of the off driller side substructure section is utilized to raise the substructure to the upright, use position. The center substructure section is connected to the side sections so that it is raised or lowered along with the side sections. The fully assembled substructure forms an integrated floor with a railing surrounding the drill floor. The drill floor forms a zero discharge floor having a perimeter drain system. Located on the drill floor are various pieces of equipment which may remain in place not only in the use position but also during disassembly and while in the transportation position.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1A:
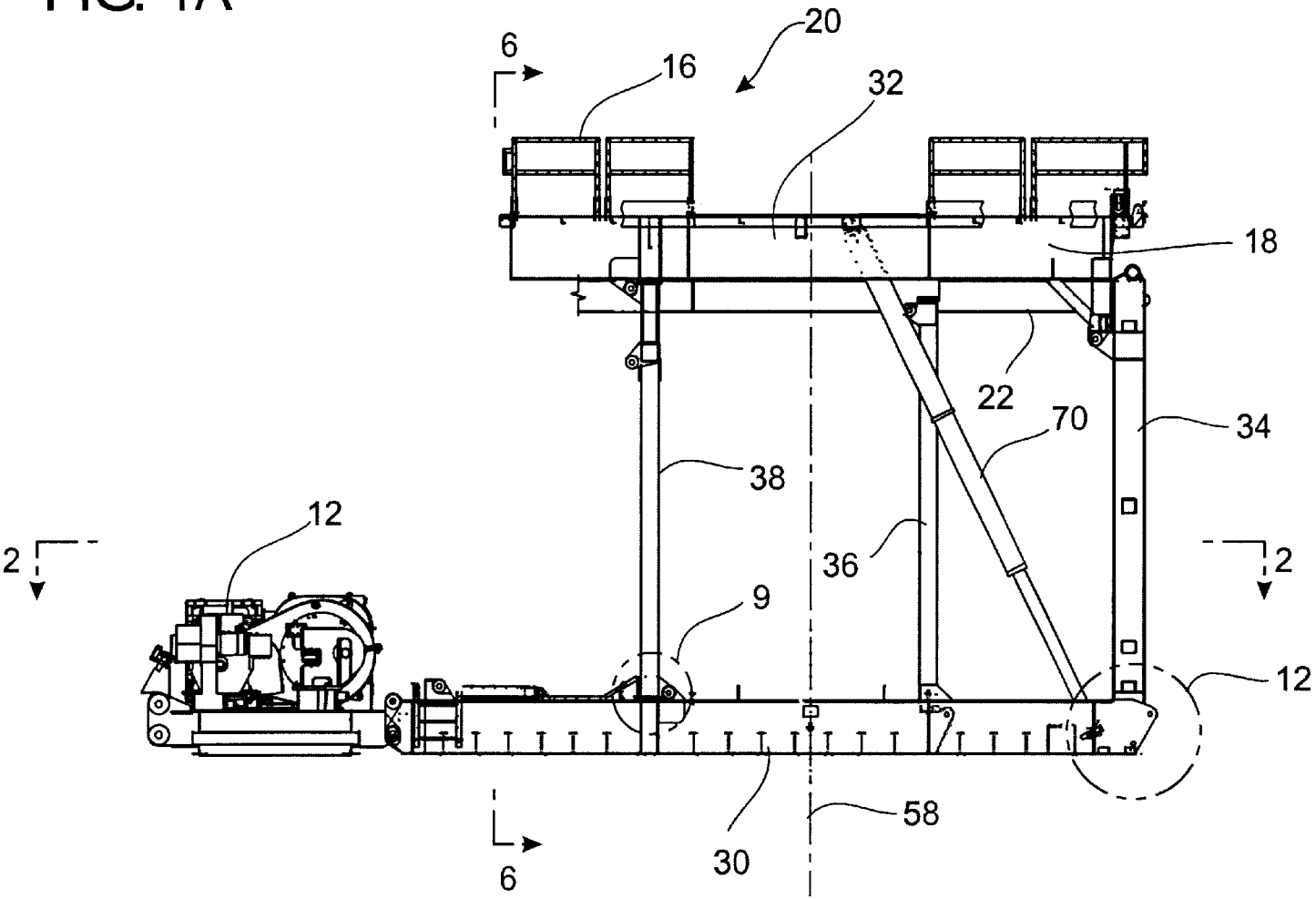
FIG. 1A is a drillers side elevational view of a modular drilling rig substructure constructed in accordance with the present invention in the use position.
Figure 1B:
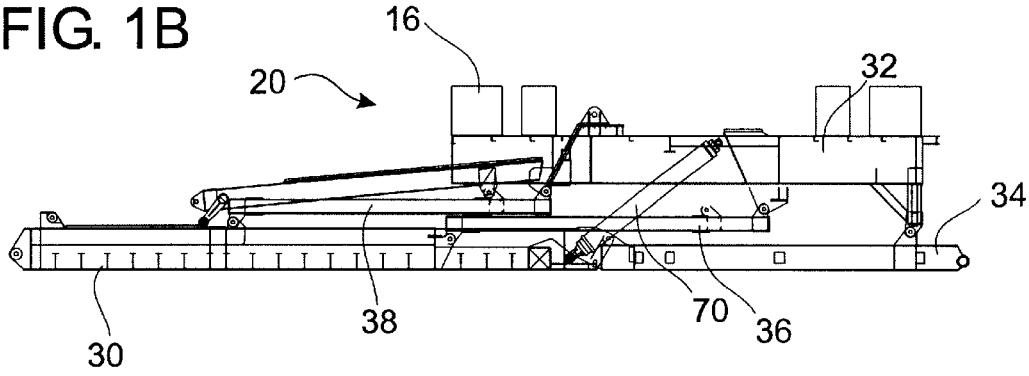
FIG. 1B is in the lowered position.

Referring to the drawings in detail, FIG. 1A is a side elevational view of a modular drilling rig substructure 10 constructed in accordance with the present invention. As seen in FIG. 1, the rig substructure is an upright, in use and fully assembled condition and in place adjacent to a drawworks 12. A mast (not shown) would be brought to and installed on the rig substructure 10.

The rig substructure 10 includes a safety railing 16 surrounding a drill floor 18. An opening in the railing 16 accommodates a personnel trailer, driller's cabin, or "dog house" for drilling rig personnel. The driller's cabin may be supported by the drill floor of the substructure or may have its own support assembly depending on the particular arrangement. Accordingly, the view in FIG. 1A is from the drillers side view. The opposite side is known as and will be described herein as the off driller side.

The drawworks 12 itself may be modular and reside on a skid to be moved to and from a rig site. The substructure is comprised of three discreet, modular components—a driller side substructure section 20 visible in FIGS. 1A, B, C and D, a center substructure section 22 partially visible in FIG. 1A, and an off driller side substructure section 24 (not visible in FIGS. 1A, B, C and D). The center section 22 is juxtaposed and lies between the driller side substructure section 20 and the off driller side substructure section 24.

Figure 1C:
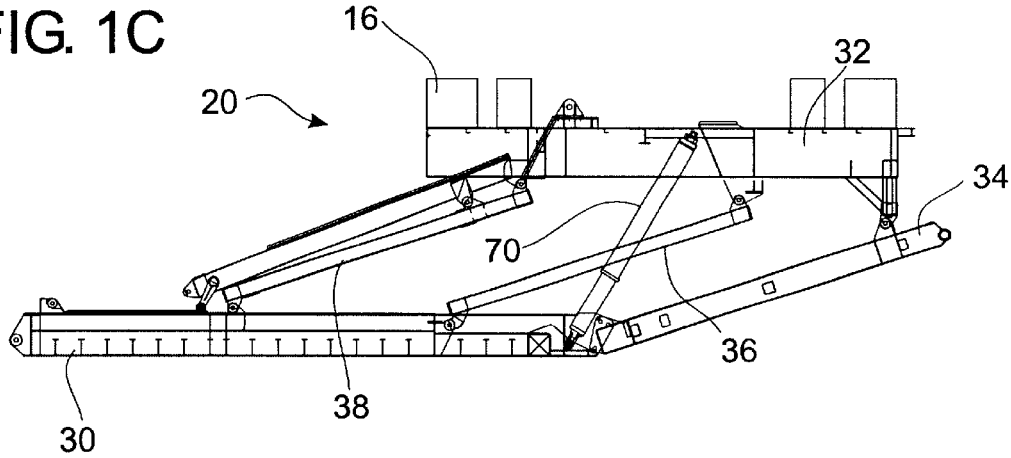
FIGS. 1C and 1D are in intermediate positions.
Figure 1D:
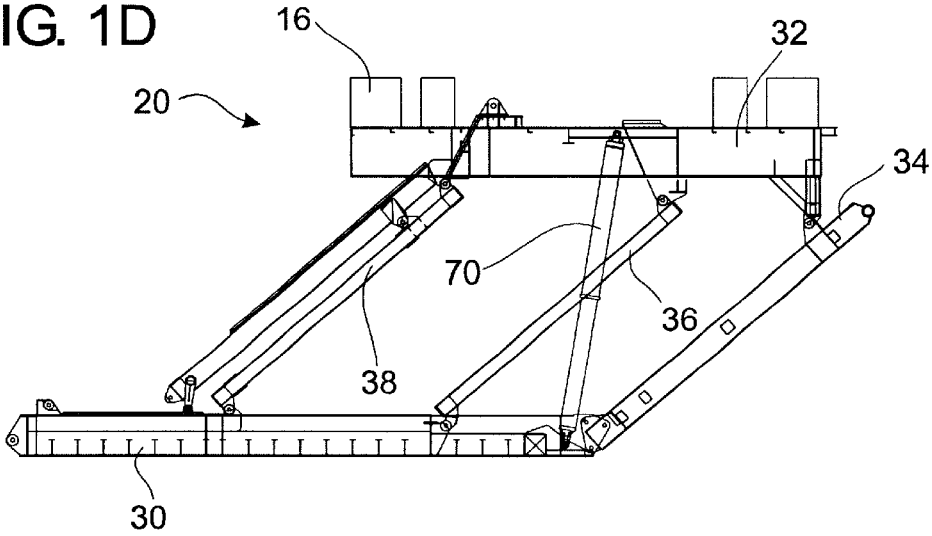

As seen in FIG. 1A, the driller side substructure section 20 includes a base 30 having a lower skid suitable to be loaded on, loaded off and transported on a trailer or other vehicle. Parallel to and spaced above the base 30 is a floor frame assembly 32. Pivotally connected between the base 30 and floor frame assembly 32 are a pair of front legs 34, a pair of middle legs 36 and a pair of rear legs 38. The front legs 34, middle legs 36 and rear legs 38 are each pivotally connected to the base 30. Likewise, the front legs 34, middle legs 36, and rear legs 38 are each pivotally connected to the floor frame assembly 32 of the driller side substructure section 20. Accordingly, the floor frame assembly 32, the base 30, the front legs 34 and rear legs 38 form a parallelogram. The floor frame assembly 32 is capable of moving between an upright, in-use position shown in FIG. 1A and a lower position parallel and adjacent to the base for transportation shown in FIG. 1B. FIGS. 1C and 1D illustrate intermediate positions between the lowered position in 1B and upright position in FIG. 1A.

The off driller side substructure section 24 operates in the same manner.

Figure 2:
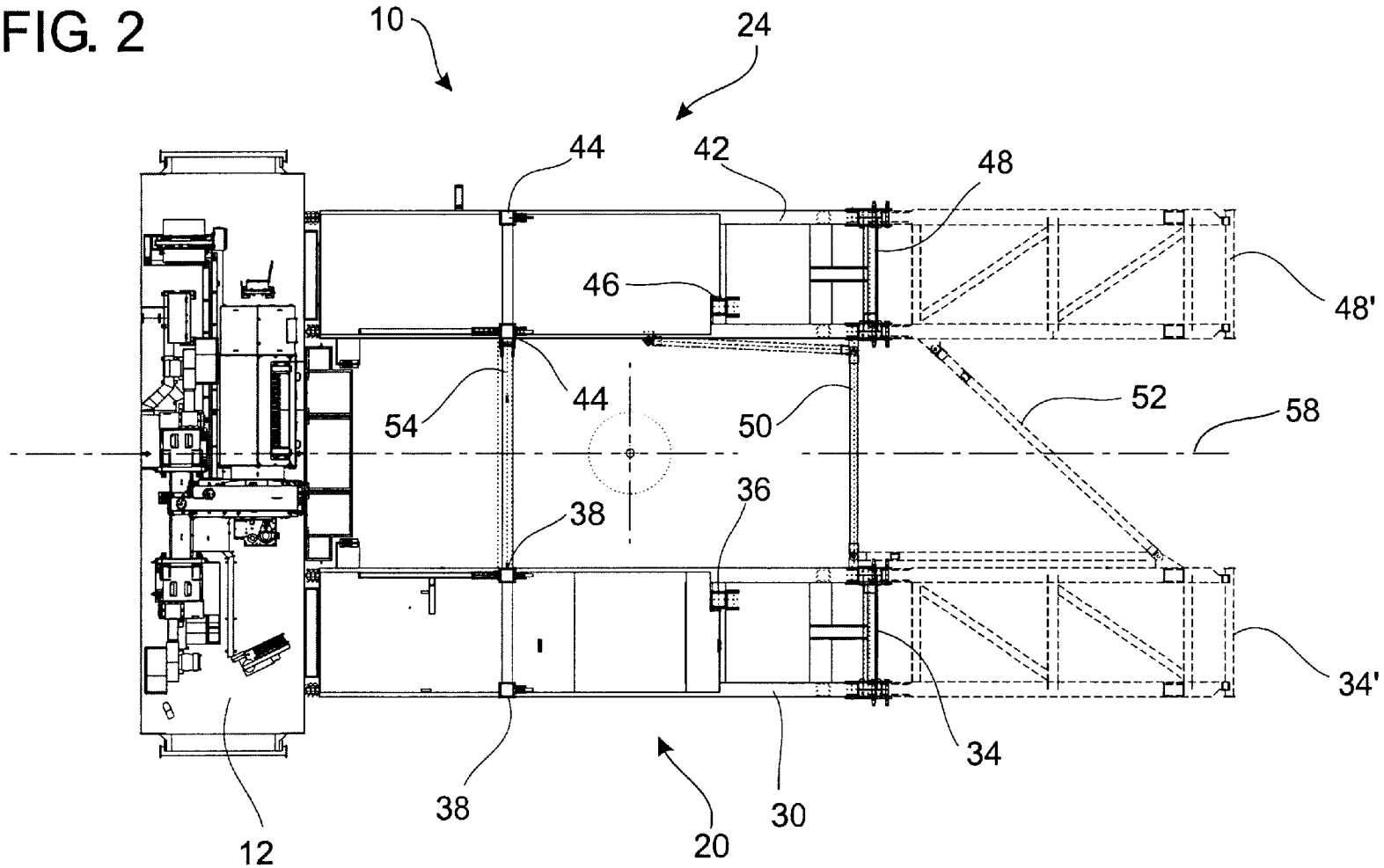
FIG. 2 is a sectional view of the modular drilling rig substructure in the use position taken along section line 2—2 of FIG. 1 with front legs of the substructure also shown in dashed lines in the lowered position.

FIG. 2 is a sectional view taken along section line 2—2 of FIG. 1A. As seen in FIG. 2, the driller side substructure section 20 and the off driller side substructure section 24 are parallel to each other and also spaced apart from each other. The space therebetween receives the center substructure section 22 which has been removed for clarity and is not seen in FIG. 2. Driller side substructure section 20 includes rear legs 38, middle legs 36 and front legs 34. When the substructure 10 is rotated from the upright, use position shown in FIGS. 1A and 2 to the lowered transportation position show in FIG. 1B, the front legs 34 will move and rotate so that they are in the position shown in dashed lines 34'.

Likewise, the off driller side substructure section 24 includes a base 42, a pair of front legs 48, middle legs 46 and a pair of rear legs 44. The front legs 48, middle legs 46, and rear legs 44 are pivotally connected to the base 42. When the substructure 10 is rotated from the upright, use position shown in FIGS. 1A and 2 to the lowered position shown in FIG. 1B, the front legs 48 will move and rotate so that they are in the position shown in dashed lines 48'.

A base brace 50 between the base 30 of the driller side substructure section and the base 42 of the off driller side substructure section is visible. The brace 50 is pivotally connected to the base 42 of the off driller side substructure section 24 and moves radially. A diagonal brace 52 between the front legs 34 and 48 and a diagonal brace 54 between the rear legs 38 and 44 may be provided for stabilization.

Figure 3:
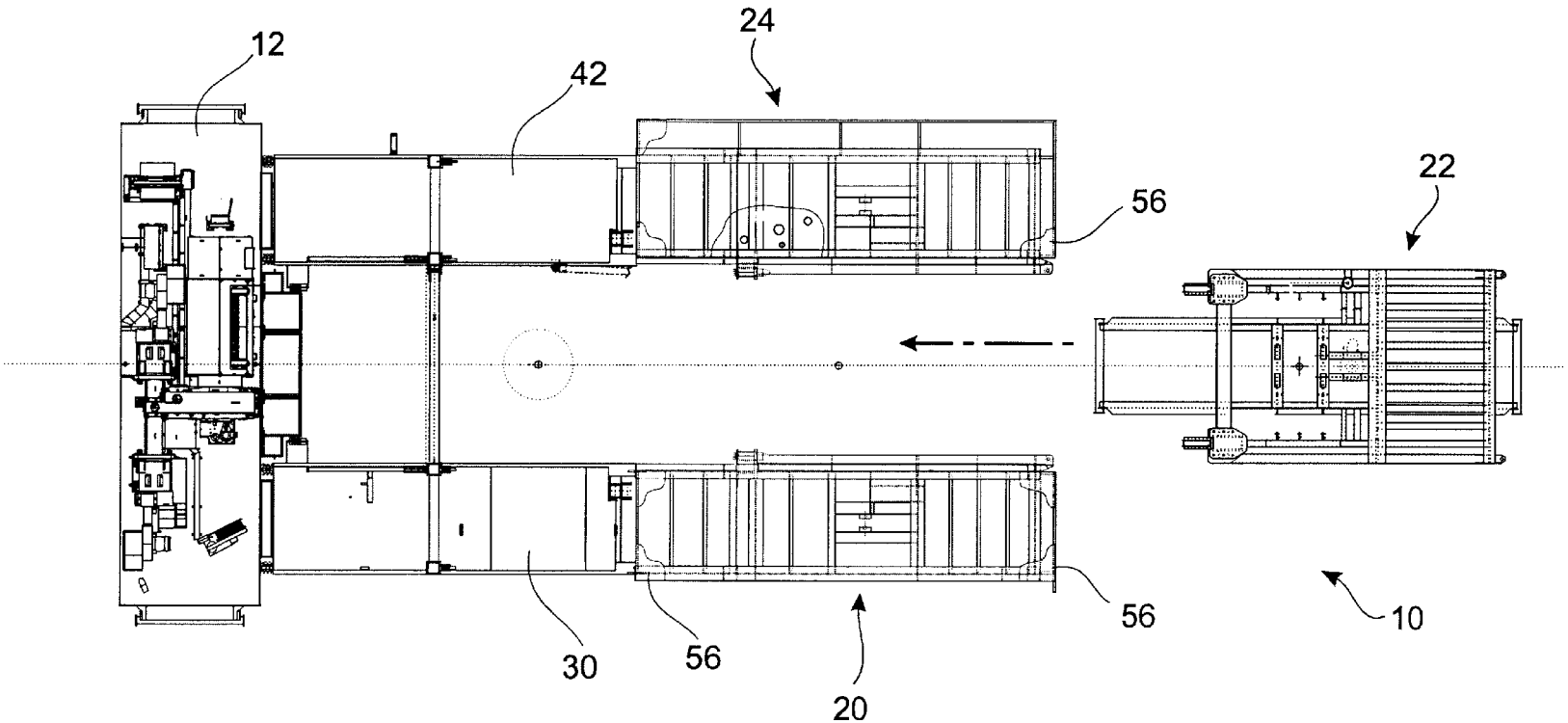
FIG. 3 is a top view showing the component sections of the drilling rig substructure in the lowered position with portions of the flooring removed for clarity.

In order to assemble a drilling rig or workover rig substructure 10, the driller side substructure section 20 and the off driller side substructure section 24 are each transported to a selected rig site in a lowered position as shown in FIG. 3. The base 30 of the driller side substructure section is adjacent the drawworks 12 while the base 42 of the off driller side substructure section is adjacent the drawworks 12. Once the off driller side section 24 and the driller side section 20 are in place, the center substructure section 22 is ready for installation. In one arrangement shown in FIG. 3, the center substructure section 22 is transported on a trailer of a truck with the space between the two side sections being wider than the width of the truck. Accordingly, the truck can back up between the drillers and off driller side sections to deposit the center substructure section in place.

For clarity, drilling floor panels 56 have been partially cut away in order to view the framework for the floor frame assembly 32 of the driller side substructure and the floor of the off driller side section.

Figure 4:
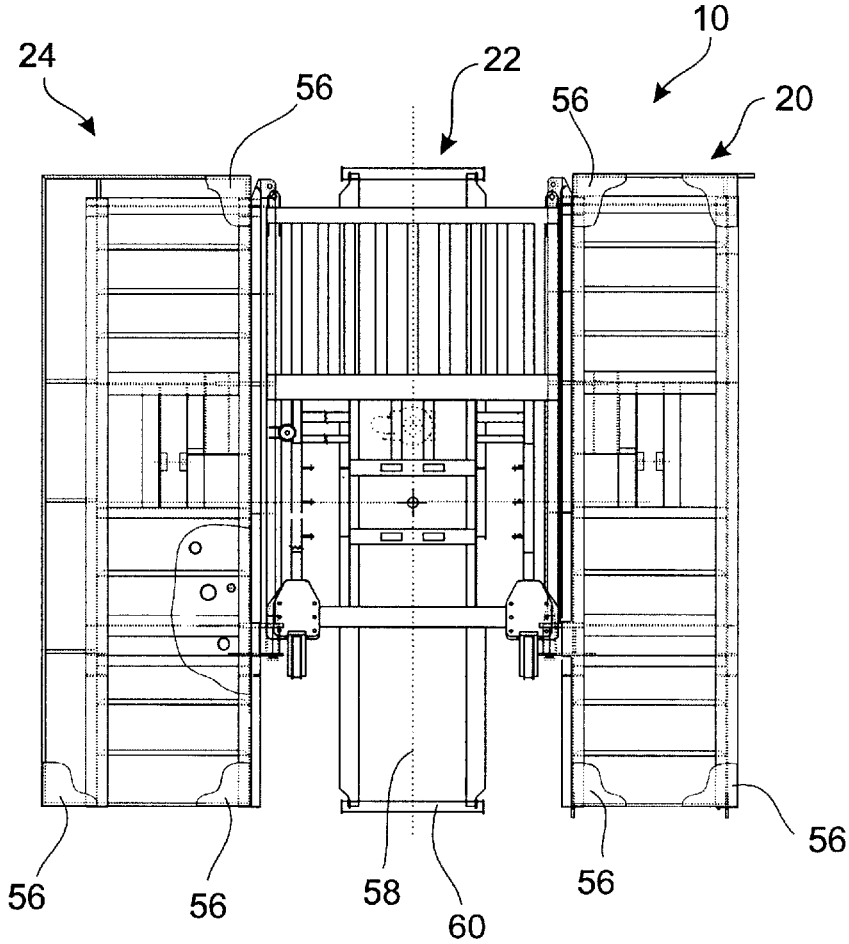
FIG. 4 is a top view of the assembled rig substructure in the use position with portions of the flooring removed for clarity.

FIG. 4 illustrates a subsequent sequence in the process whereby the center subsection 22 has been brought into place and secured to the drillers side and off drillers side sections, as will be described herein.

Intersecting dashed lines 58 depict the center line of the wellhead over which the substructure 10 is installed.

As seen in FIG. 4, the center substructure section 22 includes a frame forming a skid 60 to be received on a trailer for transportation. In one arrangement to assemble, a tandem-type trailer will move the center section 22 between the side sections and, with a rolling tail board, tip the center section to set the center section in place.

Figure 5:
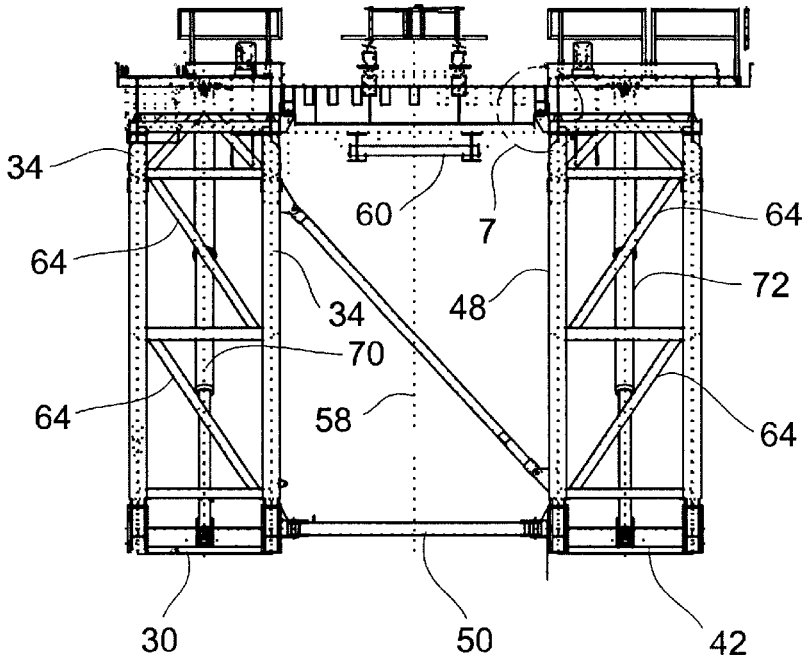
FIG. 5 is a front view of the rig substructure in the upright use position.
Figure 6:
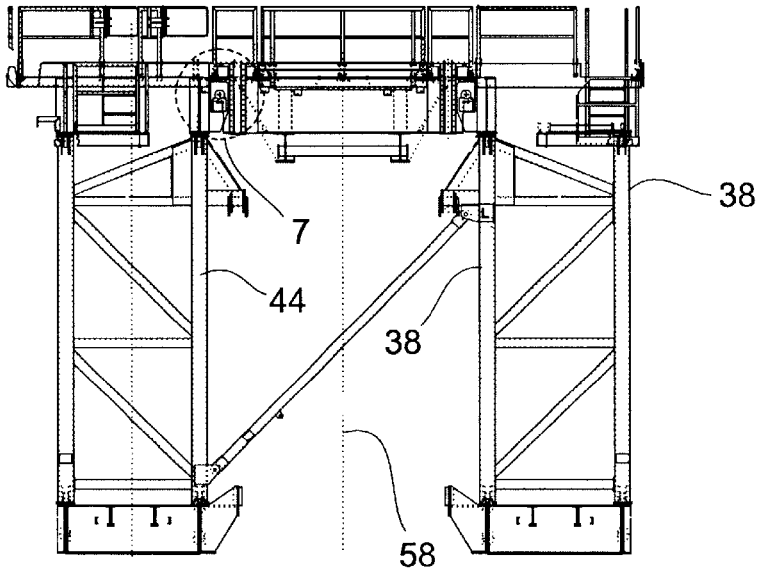
FIG. 6 is a sectional view of the rig substructure taken along section line 6—6 of FIG. 1.

FIG. 5 illustrates a front view of the substructure 10 while FIG. 6 illustrates a rear view of the substructure in the upright, use position. In FIG. 5, the pair of front legs 34 of the driller side subsection and the pair of front legs 48 of the off driller side subsection are visible. Cross bracing 64 between the pairs of front legs may be utilized. An hydraulic cylinder 70 between the base 30 and floor assembly 32 of the driller side substructure section 20 is utilized to raise the drill floor into the upright, use position. Likewise, an hydraulic cylinder 72 between the base 42 and the floor assembly of the off driller side section 24 is utilized to raise the floor to the upright, use position. The cylinders 70 and 72 are powered by the hydraulic power system of the rig. The center section is connected to the side sections so that it is raised or lowered along with side sections.

The pair of rear legs 38 of the drillers side substructure section and the pair of rear legs 44 of the off driller side substructure section are visible in FIG. 6.

Figure 7:
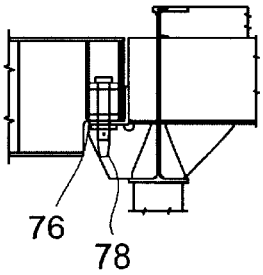
FIG. 7 is an enlarged view of the portion shown in FIG. 6.

FIG. 7 illustrates the connection between center section 22 and the side substructure sections, an enlarged view of the portion shown in the dashed line circle in FIGS. 5 and 6. The center section 22 includes a protrusion in the form of a tube 74 which extends along each side of the center section 22. The side substructure section includes an L-shaped shelf 76. The tube 74 and, in turn, the center section 22 rests upon the shelf. Accordingly, the center section 22 is supported on the shelves of the driller and off driller side substructure sections.

Figure 8:
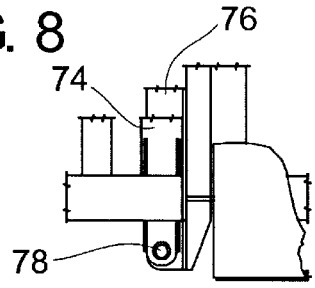
FIG. 8 is a top view of the connection shown in FIG. 7.

FIG. 8 is a top view of the connection shown in FIG. 7. A set of pins 78 extends through the tube 74 and through the shelf 76 in order to secure the center section to the side sections. While FIGS. 7 and 8 illustrate the connection between the center section and the off driller side subsection, a similar arrangement is provided to connect the center section with the drillers side section.

Figure 10:
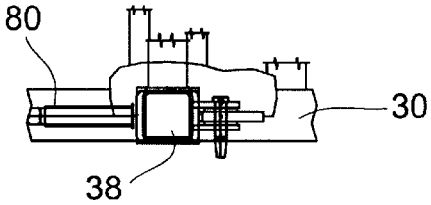
FIG. 10 is a top view of the connection shown in FIG. 9.
Figure 9:
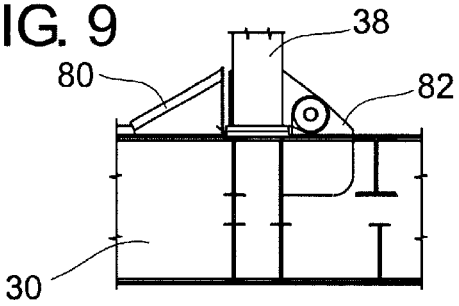
FIG. 9 is an enlarged view of the connection shown in the dashed line circle in FIG. 1.
Figure 11:
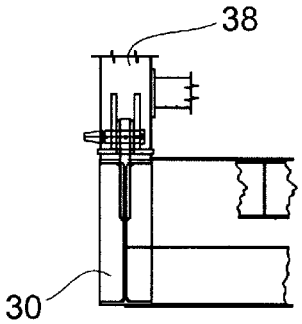
FIG. 11 is a side view of the connection shown in FIG. 9.

FIG. 9 illustrates an enlarged view of the pivotal connection between the base 30 of the drillers side section and the rear leg or legs 38. A stop 80 extending from the base 30 restricts the rear leg 38 from moving past the vertical position. The rear legs 38 move about a hinge 82 between the upright position shown in FIGS. 9, 10 and 11 and a lower position. It will be observed that the pin does not carry any of the load of the substructure while in the upright use position.

Figure 12:
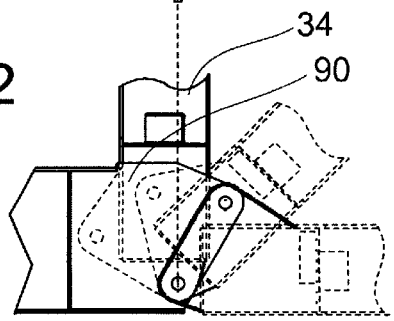
FIG. 12 is an enlarged view of the connection shown in the dashed line circle in FIG. 1.

FIG. 12 shows an enlarged view of the pivotal connection between the base 30 of the drillers side subsection and the front legs 34.

Figure 13:
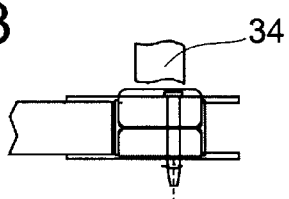
FIG. 13 is a top view of the connection shown in FIG. 12.
Figure 14:
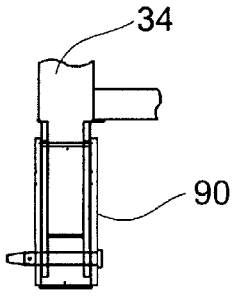
FIG. 14 is a side view of the connection shown in FIG. 12.

FIG. 13 is a top view of the pivotal connection shown in FIG. 12 while FIG. 14 is a side view of the connection shown in FIG. 12. The front legs 34 moves about hinge 90 so that the front legs 34 move between the upright position shown in FIGS. 12, 13 and 14 and a lowered, transportation position illustrated by the dashed lines in FIG. 12. The front legs terminate in a shear block which provides a contact with a base box pin plate on the base 30 to provide a significant mating area. It will be observed that the pin does not carry any of the load of the substructure while in the upright position.

Figure 15:
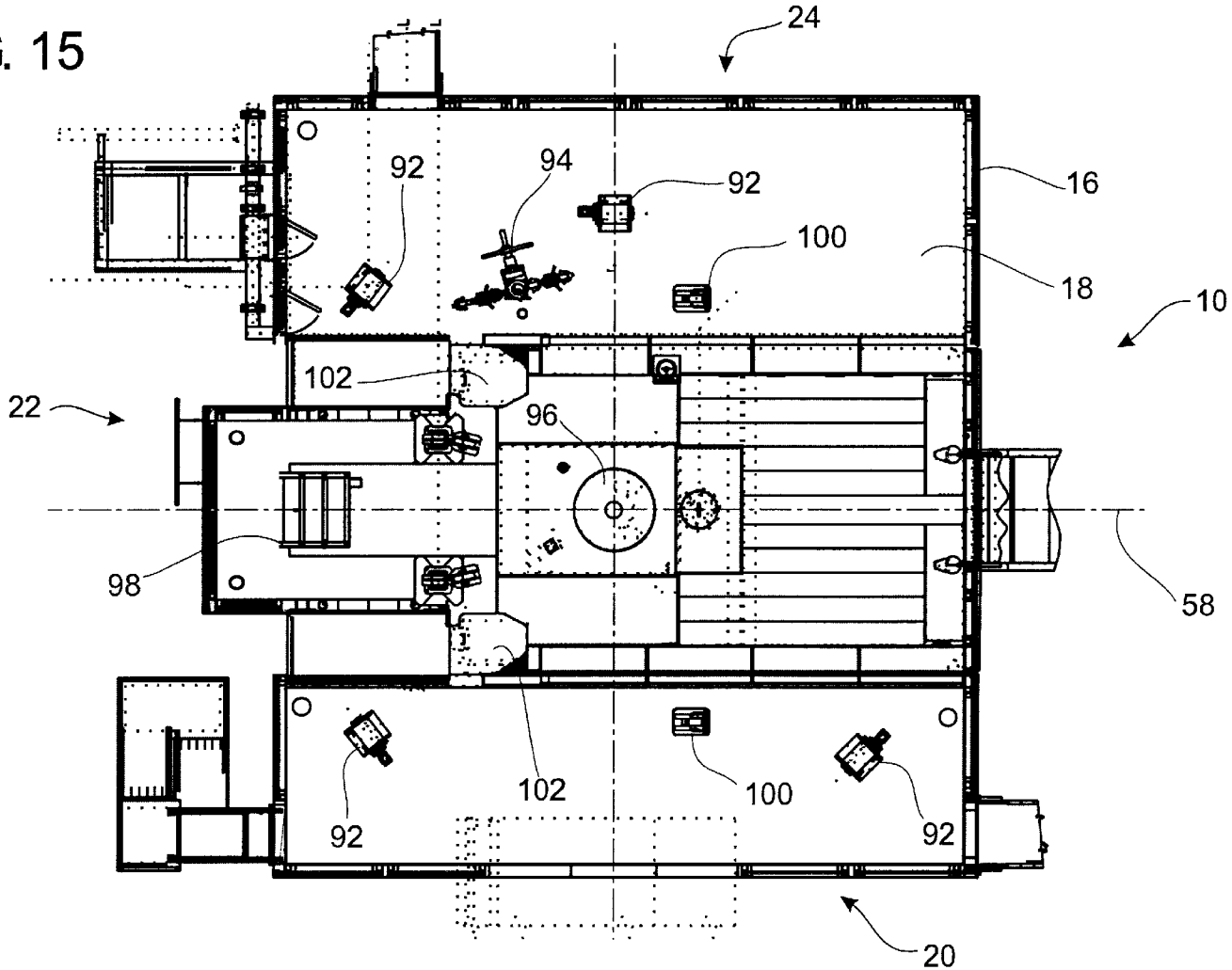
FIG. 15 is a top view of the assembled rig substructure showing various equipment on the drill floor.

FIG. 15 illustrates a top view of the fully assembled substructure with a railing 16 surrounding the entire drill floor 18. As the substructure sections have integrated floors, which are not dismantled during rig up or rig down, the drill floor 18 forms a zero discharge floor having a perimeter drain system. On the drill floor are various pieces of equipment which remain in place not only in the use position but also while in the transportation position. For example, winches 92, stand pipe manifold 94, rotary table 96, wire line unit 98 and shoes 100 and 102 for the mast are visible.

Hydraulic and electric connections can be made while the substructure 10 is in the lowered, transportation position prior to extending the hydraulic cylinders and prior to raising the substructure to the upstanding, in use position.

Whereas, the present invention has been described in relation to the drawings attached hereto, it should be understood that other and further modifications, apart from those shown or suggested herein, may be made within the spirit and scope of this invention.

What is claimed is:

1. A process to transport and assemble a drilling rig substructure, which process comprises:

transporting a driller side substructure section having a floor and a base and transporting an off driller side substructure section having a floor and a base to a rig site so that said sections are spaced from and parallel to each other;

transporting a center substructure section to said rig site;

moving said center substructure section into a space between said driller side section and said off driller side section;

connecting said center substructure section to said driller side and to said off driller side substructure section; and raising a floor of said driller side substructure section and raising a floor of said off driller side substructure section while both connected to said center substructure section from a transport position to a use position while maintaining said floors parallel to said bases.

2. A process to transport and assemble a drilling rig substructure as set forth in claim 1 wherein said step of transporting a driller side substructure section and transporting an off driller side substructure section includes each said section having a skid so that each said section may be transported on a trailer.

3. A process to transport and assemble a drilling rig substructure as set forth in claim 1 wherein said step of raising said floors includes extending an hydraulic cylinder between each said floor and said base of each said section.

4. A process to transport and assemble a drilling rig substructure as set forth in claim 1 wherein said step of connecting said center substructure section includes pinning said center substructure section to said driller side section and pinning said center substructure section to said off driller side section.

5. A process to transport and assemble a drilling rig substructure as set forth in claim 1 wherein legs pivotally connect said bases to said floors without exposing the connecting pins to hook, rotary or setback live loads.

6. A process to transport and assemble a drilling rig substructure as set forth in claim 1 including the additional step of making structural, electrical and piping connections at ground level prior to raising said floors.

7. A process to transport and assemble a drilling rig substructure as set forth in claim 1 wherein said step of connecting said center substructure section includes forming an integrated containment and drainage system that facilitates zero discharge.

8. A process to transport and assemble a drilling rig substructure as set forth in claim 1 including eliminating any requirement of a crane or a gin pole to assemble or rig up and to disassemble or rig down the substructure.

9. A process to disassemble and transport a drilling rig substructure, which process comprises:

lowering a floor of a driller side substructure section and lowering a floor of an off driller side substructure section at a rig site while said sections are connected to a center subsection from a use position to a transport position while maintaining said floors parallel to a base of each said section;

disconnecting said center substructure section from said driller side section and from said off driller side subsection; and moving said center substructure section from a space between said driller side section and said off driller side section.

10. A process to disassemble and transport a drilling rig substructure as set forth in claim 9 including moving said driller side substructure section, said off driller side substructure section and said center substructure section from said rig site on a skid for each said section.

11. A process to disassemble and transport a drilling rig substructure as set forth in claim 9 including the additional step of unmaking structural, electrical and piping connections after lowering said floor.

12. A modular drilling rig substructure, which comprises:

a driller side substructure section having a base, a floor and a plurality of legs extending between said base and said floor;

an off driller side substructure section having a base, a floor and a plurality of legs extending between said base and said floor; and a center substructure section connectable to said floor of said driller side substructure section and said floor of said off driller side substructure section, wherein said center substructure section is raised, lowered and supported only by said driller side substructure section and said off driller side substructure section.

13. A modular drilling rig substructure as set forth in claim 12 wherein said floor of said driller side substructure has an extending shelf, said floor of said off driller side substructure has an extending shelf, and said center substructure section has a pair of opposed, protruding supports so that said supports of said center section will be received and rest on said shelves.

14. A modular drilling rig substructure as set forth in claim 12 wherein structural connections are made at ground level prior to raising said floors.

15. A modular drilling rig substructure as set forth in claim 12 wherein said base of said driller side substructure section includes a driller side skid and said base of said off driller side substructure includes an off driller side skid so that each said skid may be moved onto and off of a trailer for transportation.

16. A modular drilling rig substructure as set forth in claim 12 wherein said driller side substructure section, said off driller side substructure section and said center substructure section each have an integrated drain that interlock to form a containment and drainage system that facilitates zero discharge.

17. A modular drilling rig substructure as set forth in claim 12 wherein each said leg is pivotally connected to said base and pivotally connected to said floor without exposing the connecting pins to hook, rotary or setback live loads.

18. A modular drilling rig substructure as set forth in claim 12 wherein said driller side substructure section is pinned to said center substructure section and wherein said off driller side substructure section is pinned to said center substructure section.

19. A modular drilling rig substructure as set forth in claim 12 wherein said driller side substructure includes a hydraulic cylinder between said base and said floor to move said floor between a transport and a use position, and where said off driller side substructure includes a hydraulic cylinder between said base and said floor to move said floor between a transport and a use position.

20. A modular drilling rig substructure which comprises:

a driller side substructure section having a base and a floor parallel to said base;

an off driller side substructure section having a base and a floor parallel to said base;

a center substructure section connectable to said floors; and means to move said floors while connected to said floors vertically between a storage position and a use position while maintaining said floors parallel to said bases.

21. A modular drilling rig substructure as set forth in claim 20 including drill floor equipment and handrails on said floors and center substructure section which remain in place during said movement of said floors vertically between said storage and use position.

22. Amodular drilling rig substructure as set forth in claim 20 wherein any requirement of a crane or a gin pole to assemble or rig up and to disassemble or rig down the substructure has been eliminated.

23. A process to transport and assemble a workover rig substructure, which process comprises:

transporting a driller side substructure section having a floor and a base and transporting an off driller side substructure section having a floor and a base to a rig site so that said sections are spaced from and parallel to each other;

transporting a center substructure section to said rig site;

moving said center substructure section into a space between said driller side section and said off driller side section;

connecting said center substructure section to said driller side and to said off driller side substructure section; and raising a floor of said driller side substructure section and raising a floor of said off driller side substructure section while both connected to said center substructure section from a transport position to a use position while maintaining said floors parallel to said bases.

24. A process to transport and assemble a workover rig substructure as set forth in claim 23 wherein said step of transporting a driller side substructure section and transporting an off driller side substructure section includes each said section having a skid so that each said section may be transported on a trailer.

25. A process to transport and assemble a workover rig substructure as set forth in claim 23 wherein said step of raising said floors includes extending an hydraulic cylinder between each said floor and said base of each said section.

26. A process to transport and assemble a workover rig substructure as set forth in claim 23 wherein said step of connecting said center substructure section includes pinning said center substructure section to said driller side section and pinning said center substructure section to said off driller side section.

27. A process to transport and assemble a workover rig substructure as set forth in claim 23 wherein legs pivotally connect said bases to said floors without exposing the connecting pins to hook, rotary or setback live loads.

28. A process to transport and assemble a workover rig substructure as set forth in claim 23 including the additional step of making structural, electrical and piping connections at ground level prior to raising said floors.

29. A process to transport and assemble a workover rig substructure as set forth in claim 23 wherein said step of connecting said center substructure section includes forming an integrated containment and drainage system that facilitates zero discharge.

30. A process to transport and assemble a workover rig substructure as set forth in claim 23 including eliminating any requirement of a crane or a gin pole to assemble or rig up and to disassemble or rig down the substructure.

31. A process to disassemble and transport a workover rig substructure, which process comprises:

lowering a floor of a driller side substructure section and lowering a floor of an off driller side substructure section at a rig site while said sections are connected to a center subsection from a use position to a transport position while maintaining said floors parallel to a base of each said section;

disconnecting said center substructure section from said driller side section and from said off driller side subsection; and moving said center substructure section from a space between said driller side section and said off driller side section.

32. A process to disassemble and transport a workover rig substructure as set forth in claim 31 including moving said driller side substructure section, said off driller side substructure section and said center substructure section from said rig site on a skid for each said section.

33. A process to disassemble and transport a workover rig substructure as set forth in claim 31 including the additional step of unmaking structural, electrical and piping connections after lowering said floor.

34. A modular workover rig substructure, which comprises:

a driller side substructure section having a base, a floor and a plurality of legs extending between said base and said floor;

an off driller side substructure section having a base, a floor and a plurality of legs extending between said base and said floor; and a center substructure section connectable to said floor of said driller side substructure section and said floor of said off driller side substructure section, wherein said center substructure section is raised, lowered and supported only by said driller side substructure section and said off driller side substructure section.

35. A modular workover rig substructure as set forth in claim 34 wherein said floor of said driller side substructure has an extending shelf, said floor of said off driller side substructure has an extending shelf and said center substructure section has a pair of opposed, protruding supports so that said supports of said center section will be received and rest on said shelves.

36. A modular workover rig substructure as set forth in claim 34 wherein structural connections are made at ground level prior to raising said floors.

37. A modular workover rig substructure as set forth in claim 34 wherein said base of said driller side substructure section includes a driller side skid and said base of said off driller side substructure includes an off driller side skid so that each said skid may be moved onto and off of a trailer for transportation.

38. A modular workover rig substructure as set forth in claim 34 wherein said driller side substructure section, said off driller side substructure section and said center substructure section each have an integrated drain that interlock to form a containment and drainage system that facilitates zero discharge.

39. A modular workover rig substructure as set forth in claim 34 wherein each said leg is pivotally connected to said base and pivotally connected to said floor without exposing the connecting pins to hook, rotary or setback live loads.

40. A modular workover rig substructure as set forth in claim 34 wherein said driller side substructure section is pinned to said center substructure section and wherein said off driller side substructure section is pinned to said center substructure section.

41. A modular workover rig substructure as set forth in claim 34 wherein said driller side substructure includes a hydraulic cylinder between said base and said floor to move said floor between a transport and a use position, and where said off driller side substructure includes a hydraulic cylinder between said base and said floor to move said floor between a transport and a use position.

42. A modular workover rig substructure which comprises:

a driller side substructure section having a base and a floor parallel to said base;

an off driller side substructure section having a base and a floor parallel to said base;

a center substructure section connectable to said floors; and means to move said floors while connected to said floors vertically between a storage position and a use position while maintaining said floors parallel to said bases.

43. A modular workover rig substructure as set forth in claim 42 including drill floor equipment and handrails on said floors and center substructure section which remain in place during said movement of said floors vertically between said storage and use position.

44. A modular workover rig substructure as set forth in claim 42 wherein any requirement of a crane or a gin pole to assemble or rig up and to disassemble or rig down the substructure has been eliminated.

* * * * *

Disclaimer

6,848,515—Alan Orr, Tulsa, OK, (US); Mark Trevithick, Houston, TX (US). MODULAR DRILLING RIG SUBSTRUCTURE. Patent dated Feb 1, 2005. Disclaimer and dedication filed Oct. 21, 2005, by the assignee, Helmerich & Payne, Inc.

Hereby enters this disclaimer to claims 1 [0096] 44, of said patent.

*(Official Gazette, December 13, 2005)*